US010301916B2

(12) United States Patent
Van Dongen

(10) Patent No.: US 10,301,916 B2
(45) Date of Patent: May 28, 2019

(54) METHOD FOR MANAGING PRODUCTION OF HYDROCARBONS FROM A SUBTERRANEAN RESERVOIR

(71) Applicant: Total E&P Danmark A/S, Copenhagen Ø (DK)

(72) Inventor: Hans Johannes Cornelis Maria Van Dongen, Copenhagen K (DK)

(73) Assignee: TOTAL E&P DANMARK A/S, Copenhagen Ø (DK)

( * ) Notice: Subject to any disclaimer, the term of this patent is extended or adjusted under 35 U.S.C. 154(b) by 170 days.

(21) Appl. No.: 15/301,656

(22) PCT Filed: Mar. 3, 2015

(86) PCT No.: PCT/EP2015/054344
§ 371 (c)(1),
(2) Date: Oct. 3, 2016

(87) PCT Pub. No.: WO2015/132218
PCT Pub. Date: Sep. 11, 2015

(65) Prior Publication Data

US 2017/0030174 A1 Feb. 2, 2017

(30) Foreign Application Priority Data

Mar. 3, 2014 (GB) ..... 1403676.8

(51) Int. Cl.
*E21B 33/13* (2006.01)
*E21B 43/08* (2006.01)
(Continued)

(52) U.S. Cl.
CPC ..... *E21B 43/25* (2013.01); *E21B 33/13* (2013.01); *E21B 43/08* (2013.01); *E21B 43/162* (2013.01);
(Continued)

(58) Field of Classification Search
CPC ..... E21B 49/008
See application file for complete search history.

(56) References Cited

U.S. PATENT DOCUMENTS 3,595,314 A * 7/1971 Garner ..... E21B 43/261 166/192
4,679,629 A * 7/1987 Abdo ..... E21B 43/261 166/281
(Continued)

FOREIGN PATENT DOCUMENTS

EP 1184537 A2 3/2002
EP 1184537 B1 11/2005
(Continued)

OTHER PUBLICATIONS

International Search Report and Written Opinion for PCT/EP2015/054344, dated Jul. 8, 2015.
(Continued)

*Primary Examiner* — Blake E Michener
(74) *Attorney, Agent, or Firm* — Brinks Gilson & Lione

(57) ABSTRACT

In a wellbore (1) provided with a non-cemented perforated liner (6) forming a continuous annular space (7) between the liner and the formation (2), the liner having an original perforation pattern being optimized for acid stimulation of the wellbore, the following steps are performed: injecting a hydrocarbon displacement fluid and measuring parameters relevant for inflow profiling, on the basis thereof, determining an actual inflow profile ($P_a$) over the length of the wellbore, comparing the determined actual inflow profile ($P_a$) with a preferred inflow profile ($P_p$) over the length of the wellbore, estimating, on the basis of the difference between the actual inflow profile ($P_a$) and the preferred inflow profile ($P_p$), a modified perforation pattern for the liner, determining how the original perforation pattern of the
(Continued)

Figure 2:
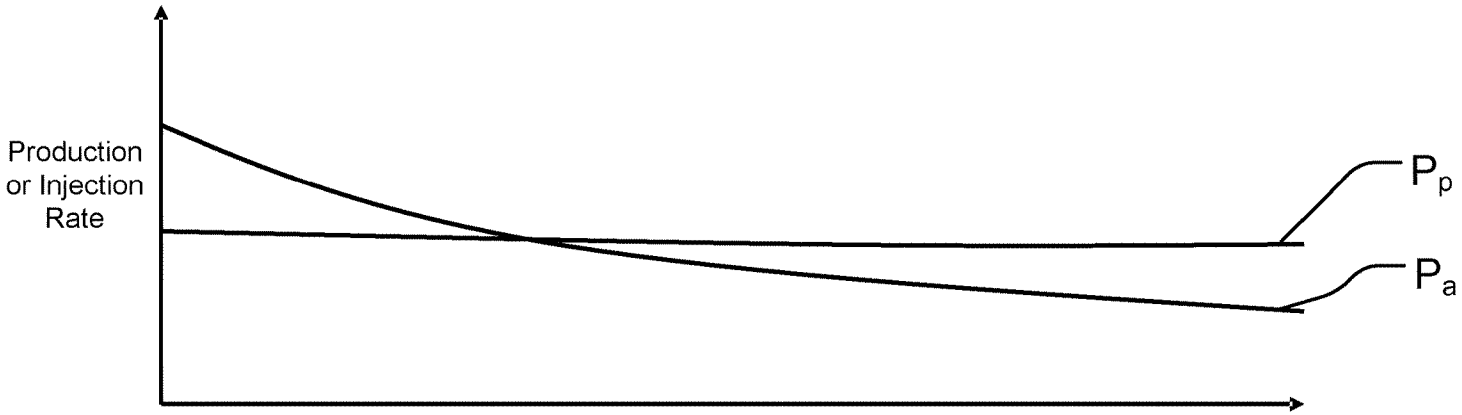

liner may be adapted to form said modified perforation pattern for the liner, and adapting the perforation pattern of the liner accordingly.

24 Claims, 1 Drawing Sheet

(51) Int. Cl.

| | |
|---|---|
| ***E21B 43/16*** | (2006.01) |
| ***E21B 43/25*** | (2006.01) |
| ***E21B 43/28*** | (2006.01) |
| ***E21B 47/10*** | (2012.01) |
| ***E21B 49/00*** | (2006.01) |

(52) U.S. Cl.
CPC ..... *E21B 43/28* (2013.01); *E21B 47/10* (2013.01); *E21B 49/008* (2013.01)

(56) References Cited

U.S. PATENT DOCUMENTS

| | | | | | |
|---|---|---|---|---|---|
| 4,702,318 | A * | 10/1987 | Chung | E21B 43/261 | 166/268 |
| 4,799,157 | A * | 1/1989 | Kucuk | E21B 49/008 | 702/12 |
| 5,156,205 | A * | 10/1992 | Prasad | E21B 49/008 | 166/250.02 |
| 7,845,407 | B2 * | 12/2010 | Bunnell | E21B 43/12 | 166/278 |
| 2006/0048942 | A1 * | 3/2006 | Moen | E21B 43/12 | 166/306 |
| 2006/0243438 | A1 * | 11/2006 | Brown | E21B 47/1005 | 166/250.02 |
| 2007/0234789 | A1 * | 10/2007 | Glasbergen | E21B 47/065 | 73/152.55 |
| 2009/0084544 | A1 * | 4/2009 | Caldera | E21B 47/06 | 166/250.07 |
| 2012/0103600 | A1 * | 5/2012 | Shako | E21B 47/06 | 166/250.07 |
| 2014/0251601 | A1 * | 9/2014 | Wang | E21B 47/065 | 166/250.01 |
| 2015/0041123 | A1 * | 2/2015 | Troshko | E21B 43/255 | 166/254.1 |
| 2015/0075775 | A1 * | 3/2015 | Davidson | E21B 28/00 | 166/245 |
| 2015/0075777 | A1 * | 3/2015 | Walters | E21B 49/008 | 166/250.1 |
| 2016/0319630 | A1 * | 11/2016 | Watson | E21B 33/13 | |

FOREIGN PATENT DOCUMENTS

| | | | |
|---|---|---|---|
| WO | 2009121882 | A1 | 10/2009 |
| WO | 2009129449 | A2 | 10/2009 |
| WO | 2011058014 | A1 | 5/2011 |

OTHER PUBLICATIONS

Preliminary Report on Patentability for PCT/EP2015/054344, dated Sep. 6, 2016.
Search report for Danish Application No. PA 2016 70780, Completed Aug. 4, 2017.
Search report for Great Britain Application No. GB1403676.8, dated Sep. 3, 2014.

* cited by examiner

METHOD FOR MANAGING PRODUCTION OF HYDROCARBONS FROM A SUBTERRANEAN RESERVOIR

RELATED APPLICATIONS

This application claims the benefit under 35 U.S.C. § 371 of the filing date of International Patent Application No. PCT/EP2015/054344, having an international filing date of Mar. 3, 2015, which claims priority to Great Britain Application No. 1403676.8, filed Mar. 3, 2014, the contents of both of which are incorporated herein by reference in their entirety.

The present invention relates to a method for managing production of hydrocarbons from a subterranean reservoir comprising a number of wellbores in the form of injectors and producers surrounded by a formation, each wellbore having a horizontal section including a heel section and a toe section, the horizontal section being provided with a non-cemented perforated liner, thereby forming a continuous at least substantially annular space between the non-cemented perforated liner and the formation, the liner having an original perforation pattern being optimized for acid stimulation of the wellbore so that the total hole area per length unit of the liner varies over the length of the liner from the heel to the toe.

EP 1 184 537 B1 (Maersk Olie og Gas A/S) discloses a method of stimulating a wellbore, wherein acid or the like aggressive liquid is supplied for decomposing material in the wellbore by use of a liner arranged within the wellbore while forming a space between the liner and the formation of the wellbore, said supplied liquid being discharged to said space through holes formed in the wall of the liner in the longitudinal expanse of the liner for influencing the formation of the wellbore. The liner may subsequently to acid stimulation be used for water injection or oil production. This type of liner is a so-called Controlled Acid Jet (CAJ) liner.

When employing such a liner for acid stimulation, the liner will typically have an original perforation pattern being optimized for acid stimulation of the wellbore so that the total hole area per length unit of the liner varies over the length of the liner from the heel to the toe. This original perforation pattern will in particular be adapted to counteract the rather large pressure loss over the length of the wellbore during acid stimulation so that the formation is treated more or less equally independently of the position along the wellbore. However, this original perforation pattern may result in less optimal hydrocarbon production along the wellbore after acid stimulation.

U.S. Pat. No. 3,595,314 discloses an apparatus for selectively plugging portions of a perforated zone in a wellbore. A wellbore apparatus having perforation ball sealers attached thereto and properly spaced along the length of the tool is positioned in a perforated wellbore liner. The wellbore apparatus is positioned so that ball sealers are adjacent to the perforations through which fluid is not desired. When fluid is pumped down the wellbore, the ball sealers are forced to enter the desired portion of the perforated wellbore liner. The apparatus provides a means for selectively plugging an interval of a perforated wellbore liner while allowing fluid to flow in other zones of the wellbore.

WO 2011/058014 A1 discloses a device for drilling a hole in a well tubular and for subsequent injection of a fluid or fluid mixture into an annular space or formation surrounding the well tubular.

WO 2009/121882 A1 discloses a method for repairing holes in pipe-in-pipe tubing by running a hole sealing device into the pipe-in-pipe tubing.

US 2007/234789 does not refer to a CAJ liner or similar, whereby an annular space is formed between a non-cemented perforated liner and the formation.

The object of the present invention is to provide a method as mentioned in the introduction whereby improved hydrocarbon production may be achieved.

In view of this object, subsequent to acid stimulation of one of the wellbores forming an injector, the following steps are performed:

- injecting a hydrocarbon displacement fluid into the perforated liner in said wellbore and measuring parameters relevant for inflow profiling,
- on the basis of the measured parameters, determining an actual inflow profile over the length of the wellbore,
- comparing the determined actual inflow profile with a preferred inflow profile over the length of the wellbore,
- estimating, on the basis of the difference between the actual inflow profile and the preferred inflow profile, a modified perforation pattern for the liner,
- determining how the original perforation pattern of the liner may be adapted to form said modified perforation pattern for the liner, and
- adapting the perforation pattern of the liner accordingly.

Thereby, the non-cemented perforated liner may be provided with a perforation pattern resulting in optimal acid stimulation, but may nevertheless also be provided with a perforation pattern resulting in optimal hydrocarbon production.

In an embodiment, subsequent to acid stimulation of one of the wellbores forming a producer, and preferably subsequent to adapting the perforation pattern of one or more liners in wellbores forming injectors, the following steps are performed:

- producing hydrocarbon from the perforated liner in said wellbore forming a producer and measuring parameters relevant for production profiling,
- on the basis of the measured parameters, determining an actual production profile over the length of the wellbore,
- comparing the determined actual production profile with a preferred production profile over the length of the wellbore,
- estimating, on the basis of the difference between the actual production profile and the preferred production profile, a modified perforation pattern for the liner,
- determining how the original perforation pattern of the liner may be adapted to form said modified perforation pattern for the liner, and
- adapting the perforation pattern of the liner accordingly.

Thereby, the hydrocarbon production may be even further optimised. By performing the steps mentioned just above subsequently to adapting the perforation pattern of one or more liners in wellbores forming injectors, having optimised the inflow profile in one or more injectors, subsequently, the production profile in wellbores forming producers may so to say be fine-tuned by performing said steps.

In an embodiment, the perforation pattern of the liner is adapted, or adapted substantially, only in a first section of the liner including the heel section, said first section of the liner having a length corresponding to less than ½, preferably less than ⅓, and most preferred less than ¼, of the total length of the liner. Thereby, the hydrocarbon production may be optimised with reduced intervention as the balance between the total hole area per length unit of the liner at the heel section and at the toe section may be modified without or substantially without modifying the perforation pattern of the liner over the entire length of the liner.

In an embodiment, the original perforation pattern of the liner being optimized for acid stimulation of the wellbore is so configured that the total hole area per length unit of the liner increases at least by a certain rate from the heel section to the toe section, and the modified perforation pattern of the liner is so configured that the total hole area per length unit of the liner increases by a rate higher than said certain rate from the heel section to the toe section. Thereby, the original perforation pattern may be adapted to counteract the rather large pressure loss over the length of the wellbore during acid stimulation so that the formation is treated more or less equally independently of the position along the wellbore, and the modified perforation pattern of the liner may be adapted to counteract the relatively lower pressure loss over the length of the wellbore during injection of a hydrocarbon displacement fluid into the perforated liner or during production of hydrocarbon from the perforated liner. In this way, hydrocarbon production may be evened more or less out over the length of the wellbore or otherwise adapted to requirements.

In an embodiment, the perforation pattern of the liner is adapted by plugging a number of holes forming the original perforation pattern of the liner. Thereby, the hydrocarbon production may be optimised by modifying the balance between the total hole area per length unit of the liner at the heel section and at the toe section and at the same time reducing the total hole area over the length of the liner.

In an embodiment, the perforation pattern of the liner is adapted only in a first section of the liner including the heel section, said first section of the liner having a length corresponding to less than ½, preferably less than ⅓, and most preferred less than ¼, of the total length of the liner, and that at least every other hole is plugged in said first section of the liner.

In an embodiment, at least some holes of the liner are plugged with a sealant forming a plug that does not or that does substantially not close the continuous at least substantially annular space between the liner and the formation, whereby preferably, the plug is flush with or substantially flush with an outer surface of the liner, and preferably, the plug is flush with or substantially flush with an inner surface of the liner. Thereby, the at least substantially annular space may at least substantially remain open continuously over the entire length of the wellbore, whereby a large contact area between the wellbore and the formation may be maintained. This may facilitate and/or improve hydrocarbon recovery.

In an embodiment, at least some holes of the liner are plugged with a sealant forming a plug that closes the continuous at least substantially annular space between the liner and the formation over less than 90 percent, preferably over less than 80 percent, more preferred over less than 70 percent, even more preferred over less than 60 percent, even more preferred over less than 50 percent, even more preferred over less than 40 percent, even more preferred over less than 30 percent, even more preferred over less than 20 percent, and most preferred over less than 10 percent, of the circumference of the liner at the longitudinal position of the hole in the liner. Thereby, the at least substantially annular space may at least substantially or at least to a certain degree remain open continuously over the entire length of the wellbore, whereby a large contact area between the wellbore and the formation may be maintained. This may facilitate and/or improve hydrocarbon recovery.

In an embodiment, at least some holes of the liner are plugged with a sealant forming a plug that closes the continuous at least substantially annular space between the liner and the formation over more than 10 percent, preferably over more than 20 percent, more preferred over more than 30 percent, even more preferred over more than 40 percent, even more preferred over more than 50 percent, even more preferred over more than 60 percent, even more preferred over more than 70 percent, even more preferred over more than 80 percent, even more preferred over more than 90 percent, and most preferred over, or approximately over, 100 percent, of the circumference of the liner at the longitudinal position of the hole in the liner. Thereby, the at least substantially annular space may to a certain degree, at least substantially or even entirely be closed off at the position of some holes of the liner, whereby the effect of the modification of the perforation pattern of the liner may so to say be boosted, so that a relatively larger effect may be achieved by plugging relatively few holes. This may be achieved as a result of wellbore fluids in the at least substantially annular space being prevented from or hindered in flowing in the longitudinal direction of the liner at the specific positions of said holes.

In an embodiment, before or after modifying the perforation pattern of the liner in one of the wellbores, a fracture, thief zone or high permeability zone in the formation surrounding the wellbore is sealed by injection of a sealant into the formation. Thereby, large imperfections in the wellbores may be repaired inside the formation itself as opposed to modifications performed in the wellbore by modifying the perforation pattern of the liner or possibly blocking the at least substantially annular space partly or entirely at specific positions.

Figure 1:
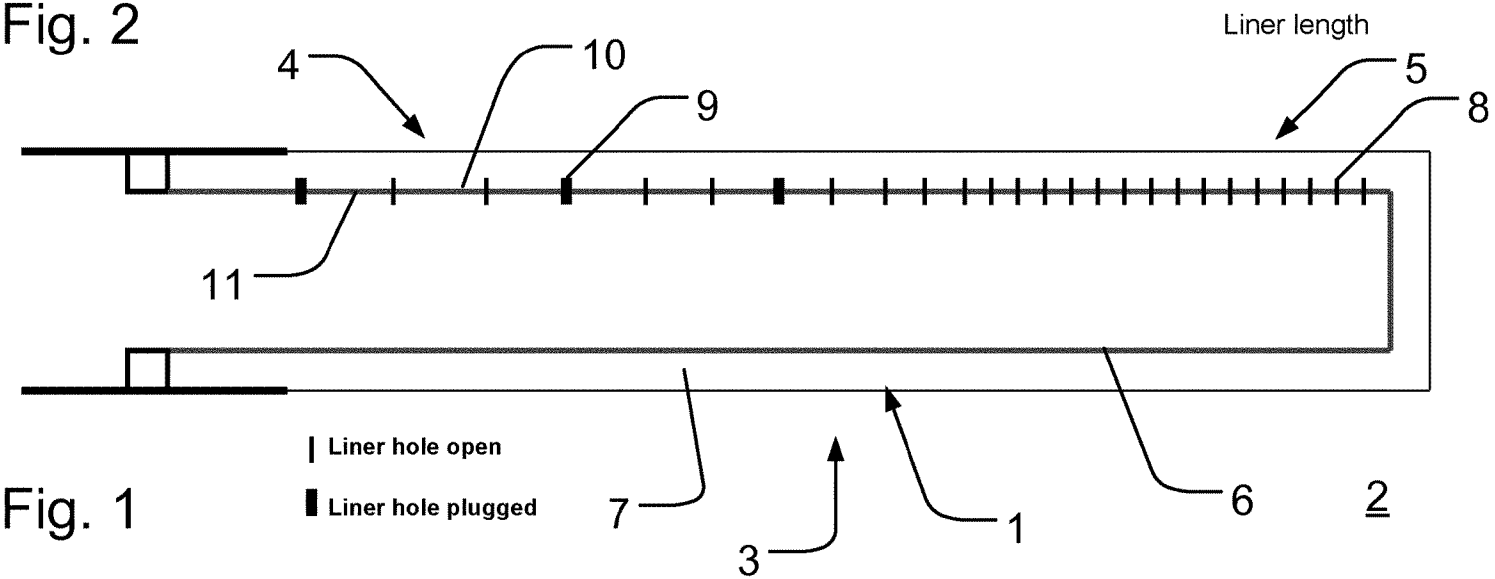

The invention will now be explained in more detail below by means of examples of embodiments with reference to the very schematic drawing, in which FIG. 1 is an axial section though a liner in a wellbore illustrating a modification of a perforation pattern of the liner according to the invention, and FIG. 2 is an illustration of an example of an inflow profile or production profile before and after modification of a perforation pattern of the liner in FIG. 1.

FIG. 1 illustrates a wellbore 1 in a subterranean hydrocarbon reservoir comprising a number of wellbores in the form of injectors and producers surrounded by a formation 2. Each wellbore 1 has a horizontal section 3 including a heel section 4 and a toe section 5. The horizontal section 3 is provided with a non-cemented perforated liner 6, thereby forming a continuous at least substantially annular space 7 between the non-cemented perforated liner 6 and the formation 2. The liner 6 has an original perforation pattern that is optimized for acid stimulation of the particular wellbore 1 on the basis of information on the formation 2 so that the total hole area per length unit of the liner 6 varies over the length of the liner from the heel section 4 (the inner part of the wellbore 1) to the toe section 5 (the outer part of the wellbore 1). This type of liner is called a Controlled Acid Jet (CAJ) liner.

Before the production of oil and gas can be initiated, it is typically necessary to stimulate a wellbore 1 by pumping down acid that decomposes the compacted layer of drilling mud on the wall of the wellbore 1 and a part of the formation. Once the drilling mud has been decomposed, the non-cemented perforated liner 6 may be used for injection of a hydrocarbon displacement fluid, such as sea water, or oil production. A CAJ liner typically has an original perforation pattern or hole distribution whereby the total hole area per length unit of the liner increases from the heel section 4 to the toe section 5. Thereby, efficient acid stimulation of the complete horizontal section 3 of the wellbore 1 may be achieved, as the hole distribution may compensate for the pressure loss along the wellbore 1.

A CAJ liner may therefore typically have an original perforation pattern or hole distribution, wherein, for instance, holes are evenly spaced along the liner, but has increasing size from the heel section 4 to the toe section 5, or wherein holes 8 are equally sized but distributed with decreasing mutual distance from the heel section 4 to the toe section 5. The latter distribution is exemplified in FIG. 1. Of course, the holes may also have increasing size and be distributed with decreasing mutual distance from the heel section 4 to the toe section 5. FIG. 1 illustrates only top holes 8 in the liner 6; however, the holes may also be provided at other positions, such as at the bottom of the liner.

By way of example only, a CAJ liner may have an average hole distribution of one or two holes per 30 metres, and the holes may have a diameter of 4 to 5 millimetres. The horizontal section 3 of the wellbore 1 may, for instance, be 5 to 6 kilometres long. The length of the acid column travelling through the inside of the non-cemented perforated liner 6 is gradually decreasing while bullheading or pumping due to continuous acid jetting through the holes 8 in the liner 6 to the continuous at least substantially annular space 7 between the liner 6 and the formation 2. Furthermore, friction pressure losses are experienced along the horizontal section 3. These factors are taken into account when designing the distribution and sizes of the holes 8 along the liner 6.

Acidizing may be performed in long horizontal CAJ liners by bullheading with high pump rates, such as up to 5 cubic meters per minute. Production/injection rates may however be substantially lower. A typical injector/producer may be operated at 0.4-1.2 cubic metres per minute.

The method for managing production of hydrocarbons from a subterranean reservoir according to the invention is carried out as follows. In at least one of the wellbores forming an injector, whereby acid stimulation has been performed by means of a non-cemented perforated liner 6, for instance as the one illustrated in FIG. 1, the following steps are performed:

- a hydrocarbon displacement fluid is injected into the perforated liner 6 in said wellbore 1 and parameters relevant for inflow profiling are measured,
- on the basis of the measured parameters, an actual inflow profile $P_a$ over the length of the wellbore 1 is determined,
- the determined actual inflow profile $P_a$ is compared with a preferred inflow profile $P_p$ over the length of the wellbore 1,
- on the basis of the difference between the actual inflow profile $P_a$ and the preferred inflow profile $P_p$, a modified perforation pattern for the liner 6 is estimated,
- it is determined how the original perforation pattern of the liner 6 may be adapted to form said modified perforation pattern for the liner 6, and
- the perforation pattern of the liner 6 is adapted accordingly.

In FIG. 1, the original perforation pattern is constituted by all the holes 8 before plugging of some of the holes. Still open holes 8 are illustrated by means of dashed lines and plugged holes are illustrated by means of bold lines. The modified perforation pattern is constituted by the still open holes.

In FIG. 2, the determined actual inflow profile $P_a$, before modification of the perforation pattern of the liner 6, is illustrated by means of a dashed line. It is seen that in the illustrated case, inflow is larger at the heel section 4 than at the toe section 5. Furthermore, in FIG. 2, the preferred inflow profile $P_p$, is illustrated by means of a continuous line. In the ideal situation, an actual inflow profile $P_a$, determined after modification of the perforation pattern of the liner 6, would result in an inflow profile corresponding to the preferred inflow profile $P_p$ illustrated in FIG. 2. However, in reality, this may be difficult or impossible to achieve, at least by a single execution of the above-mentioned steps for modification of the perforation pattern of the liner 6. Therefore, in order to optimize the inflow profile, the above-mentioned steps of the method according to the invention may be repeated one or more time.

Furthermore, preferably after having modified the perforation pattern of the liner 6 in one or more of the wellbores 1 forming an injector, it may be advantageous to also modify the perforation pattern of the liner 6 in one or more of the wellbores 1 forming producers. Thereby, the hydrocarbon production may be even further optimised or fine-tuned.

This may be done by, subsequent to acid stimulation of one of the wellbores 1 forming a producer, performing the following steps:

- producing hydrocarbon from the perforated liner 6 in said wellbore 1 forming a producer and measuring parameters relevant for production profiling,
- on the basis of the measured parameters, determining an actual production profile $P_a$ over the length of the wellbore 1,
- comparing the determined actual production profile $P_a$ with a preferred production profile $P_p$ over the length of the wellbore 1,
- estimating, on the basis of the difference between the actual production profile $P_a$ and the preferred production profile $P_p$, a modified perforation pattern for the liner 6,
- determining how the original perforation pattern of the liner 6 may be adapted to form said modified perforation pattern for the liner 6, and
- adapting the perforation pattern of the liner 6 accordingly.

Although the preferred inflow profile $P_p$ (or production profile) in FIG. 2 is illustrated as being constant over the length of the liner 6, this may not necessarily always be the case. For instance, when production is initiated for the first time in a new wellbore 1, it may be preferred to accept a larger production rate at the heel section 4 than at the toe section 5. The hydrocarbon pressure will typically be higher at the heel section 4 at the beginning of production, as the wellbores may typically extend from the middle of the hydrocarbon reservoir. Typically some years later, for instance five years after setting in production, it may be preferred to equal out the production profile by modification of the perforation pattern for the liner 6 by means of performing the steps mentioned above. For instance, it may be preferred to carry out these steps every five years for a hydrocarbon reservoir. Every time, the preferred inflow profile $P_p$ (or production profile) may be different, according to actual requirements and conditions.

The perforation pattern of the liner 6 may be adapted, or adapted substantially, only in a first section of the liner including the heel section, said first section of the liner having a length corresponding to less than ½, preferably less than ⅓, and most preferred less than ¼, of the total length of the liner. These possible configurations will look similar to the illustration of FIG. 1.

For instance, the perforation pattern of the liner 6 may be adapted by plugging at least every other hole 8 forming part of the original perforation pattern of the liner 6 in a first section of the liner having a length corresponding to less than ½, preferably less than ⅓, and most preferred less than ¼, of the total length of the liner.

For instance, the perforation pattern of the liner 6 may be adapted by plugging, preferably evenly, two thirds of the holes 8 forming part of the original perforation pattern of the liner 6 in a first section of the liner having a length corresponding to less than ½, preferably less than ⅓, and most preferred less than ¼, of the total length of the liner.

The original perforation pattern of the liner 6 optimized for acid stimulation of the wellbore 1 may be so configured that the total hole area per length unit of the liner increases at least by a certain rate from the heel section 4 to the toe section 5, and the modified perforation pattern of the liner may be so configured that the total hole area per length unit of the liner increases by a rate higher than (for instance 10 percent, or 30 percent, or even 50 percent higher than) said certain rate from the heel section 4 to the toe section 5. This is the situation illustrated schematically in FIG. 1.

Furthermore, as illustrated in FIG. 1, the perforation pattern of the liner 6 may be adapted by plugging a number of holes 8 forming the original perforation pattern of the liner 6.

In an embodiment, at least some holes 8 of the liner 6 are plugged with a sealant forming a plug 9 that does not or that does substantially not close the continuous at least substantially annular space 7 between the liner 6 and the formation 2, whereby preferably, the plug 9 is flush with of substantially flush with an outer surface 10 of the liner 6, and whereby preferably, the plug 9 is flush with or substantially flush with an inner surface 11 of the liner 6.

In an embodiment, at least some holes 8 of the liner 6 are plugged with a sealant forming a not illustrated plug that closes the continuous at least substantially annular space 7 between the liner 6 and the formation 2 over less than 90 percent, preferably over less than 80 percent, more preferred over less than 70 percent, even more preferred over less than 60 percent, even more preferred over less than 50 percent, even more preferred over less than 40 percent, even more preferred over less than 30 percent, even more preferred over less than 20 percent, and most preferred over less than 10 percent, of the circumference of the liner 6 at the longitudinal position of the hole 8 in the liner 6.

In an embodiment, at least some holes 8 of the liner 6 are plugged with a sealant forming a not illustrated plug that closes the continuous at least substantially annular space 7 between the liner 6 and the formation 2 over more than 10 percent, preferably over more than 20 percent, more preferred over more than 30 percent, even more preferred over more than 40 percent, even more preferred over more than 50 percent, even more preferred over more than 60 percent, even more preferred over more than 70 percent, even more preferred over more than 80 percent, even more preferred over more than 90 percent, and most preferred over, or approximately over, 100 percent, of the circumference of the liner 6 at the longitudinal position of the hole in the liner 6.

It may be required, before or after modifying the perforation pattern of the liner 6 in one of the wellbores 1, to seal a not illustrated fracture or thief zone in the formation 2 surrounding the wellbore 1 by injection of a sealant into the formation 2.

A hydrocarbon reservoir typically has different zones with different permeability. If the permeability of one zone is higher than the average permeability in the rest of the reservoir, it may be referred to as a so-called thief zone. Thief zones are common in hydrocarbon reservoirs and may increase the risk of a production well producing large volumes of water if such thief zone connects a production well to a source of water. Fluid can also flow via fractures in the reservoir. Thief zones are normally sealed off by injecting a sealing fluid into the relevant part of the formation.

Although the invention is described referring to a subterranean hydrocarbon reservoir comprising a number of wellbores in the form of injectors and producers, it is noted that, in order to optimize production, at some point in time, it is possible to turn some or all injectors into producers and vice versa. Therefore, for instance, when referring to an injector, the injector may earlier have been a producer or may subsequently be turned into a producer.

The invention claimed is:

1. A method for managing production of hydrocarbons from a subterranean reservoir comprising at least one injector wellbore and at least one producer wellbore, each surrounded by a formation, each wellbore having a horizontal section including a heel section and a toe section, the horizontal section being provided with a non-cemented perforated liner, thereby forming a continuous at least substantially annular space between the non-cemented perforated liner and the formation, the liner having an original perforation pattern for acid stimulation of the wellbore so that the total hole area per length unit of the liner varies over the length of the liner from the heel to the toe, wherein an acid stimulation of one of said injector wellbores is performed and subsequently the following steps are performed:

- injecting a hydrocarbon displacement fluid into the perforated liner of said one injector wellbore and measuring parameters relevant for inflow profiling,
- on the basis of the measured parameters, determining an actual inflow profile ($P_a$) over the length of said one injector wellbore,
- comparing the determined actual inflow profile ($P_a$) with a preferred inflow profile ($P_p$) over the length of said one injector wellbore,
- estimating, on the basis of the difference between the actual inflow profile ($P_a$) and the preferred inflow profile ($P_p$), a modified perforation pattern for the liner of said one injector wellbore
- determining how the original perforation pattern of the liner of said one injector wellbore may be adapted to form said modified perforation pattern for the liner of said one injector wellbore, and
- adapting the original perforation pattern of the liner of said one injector wellbore accordingly.

2. A method according to claim 1, whereby acid stimulation of at least one of said producer wellbores is performed and, subsequently, the following steps are performed:

- producing hydrocarbon from the perforated liner of said producer wellbore and measuring parameters relevant for production profiling,
- on the basis of the measured parameters, determining an actual production profile ($P_a$) over the length of said producer wellbore,
- comparing the determined actual production profile ($P_a$) with a preferred production profile ($P_p$) over the length of said producer wellbore,
- estimating, on the basis of the difference between the actual production profile ($P_a$) and the preferred production profile ($P_p$), a modified perforation pattern for the liner of said producer wellbore, determining how the original perforation pattern of the liner of said producer wellbore may be adapted to form said modified perforation pattern for the liner of said producer wellbore, and adapting the original perforation pattern of the liner of said producer wellbore accordingly.

3. The method according to claim 2, whereby the perforation pattern of the liner of said producer wellbore is adapted only in a first section of the liner of said producer wellbore including the heel section, said first section of the liner of said producer wellbore having a length corresponding to less than ½of the total length of the liner of said producer wellbore.

4. The method according to claim 2, whereby the original perforation pattern of the liner of said producer wellbore is so configured that the total hole area per length unit of the liner of said producer wellbore increases at least by a certain rate from the heel section to the toe section, and whereby the modified perforation pattern of the liner of said producer wellbore is so configured that the total hole area per length unit of the liner of said producer wellbore increases by a rate higher than said certain rate from the heel section to the toe section.

5. The method according to claim 2, whereby the perforation pattern of the liner of said producer wellbore is adapted by plugging a number of holes forming the original perforation pattern of the liner of said producer wellbore.

6. The method according to claim 2, whereby the perforation pattern of the liner of said producer wellbore is adapted only in a first section of the liner of said producer wellbore including the heel section, said first section of the liner of said producer wellbore having a length corresponding to between ½and ⅓the total length of the liner, from ⅓to ¼of the total length of the liner of said injector wellbore, or less than ¼of the total length of the liner of said producer wellbore, and that at least every other hole is plugged in said first section of the liner of said producer wellbore.

7. The method according to claim 2, whereby, before or after modifying the perforation pattern of the liner of said producer wellbore in one of the wellbores, a fracture, thief zone or high permeability zone in the formation surrounding the wellbore is sealed by injection of a sealant into the formation.

8. The method according to claim 2, whereby the perforation pattern of the liner of said producer wellbore is only in a first section of the liner of said producer wellbore including the heel section, said first section of the liner of said producer wellbore having a length corresponding to less than ⅓of the total length of the liner of said producer wellbore.

9. The method according to claim 2, whereby the perforation pattern of the liner of said producer wellbore is adapted only in a first section of the liner of said producer wellbore including the heel section, said first section of the liner of said producer wellbore having a length corresponding to less than ¼, of the total length of the liner of said producer wellbore.

10. The method according to claim 1, whereby the perforation pattern of the liner of said injector wellbore is adapted only in a first section of the liner of said injector wellbore including the heel section, said first section of the liner of said injector wellbore having a length corresponding to less than ½of the total length of the liner of said injector wellbore.

11. The method according to claim 10, whereby the original perforation pattern of the liner of said injector wellbore is so configured that the total hole area per length unit of the liner of said injector wellbore increases at least by a certain rate from the heel section to the toe section, and whereby the modified perforation pattern of the liner of said injector wellbore is so configured that the total hole area per length unit of the liner of said injector wellbore increases by a rate higher than said certain rate from the heel section to the toe section.

12. The method according to claim 10, whereby the perforation pattern of the liner of said injector wellbore is adapted by plugging a number of holes forming the original perforation pattern of the liner of said injector wellbore.

13. The method according to claim 1, whereby the original perforation pattern of the liner of said injector wellbore is so configured that the total hole area per length unit of the liner of said injector wellbore increases at least by a certain rate from the heel section to the toe section, and whereby the modified perforation pattern of the liner of said injector wellbore is so configured that the total hole area per length unit of the liner of said injector wellbore increases by a rate higher than said certain rate from the heel section to the toe section.

14. The method according to claim 1, whereby the perforation pattern of the liner of said injector wellbore is adapted by plugging a number of holes forming the original perforation pattern of the liner of said injector wellbore.

15. The method according to claim 14, whereby at least some holes of the liner of said injector wellbore are plugged with a sealant forming a plug that does not close the continuous at least substantially annular space between the liner of said injector wellbore and the formation, whereby the plug is flush with an outer surface of the liner of said injector wellbore and an inner surface of the liner of said injector wellbore.

16. The method according to claim 14, whereby at least some holes of the liner of said injector wellbore are plugged with a sealant forming a plug that closes the continuous at least substantially annular space between the liner of said injector wellbore and the formation over 90% to 80%, over 80 % to 70%, over 70% to 60%, over 60% to 50%, over 50% to 40%, over 40% to 30%, over 30% to 20%, over 20% to 10%, or over less than 10% of the circumference of the liner of said injector wellbore at the longitudinal position of the hole in the liner of said injector wellbore.

17. The method according to claim 14, whereby at least some holes of the liner of said injector wellbore are plugged with a sealant forming a plug that closes the continuous at least substantially annular space between the liner of said injector wellbore and the formation over 10% to 20%, over 20% to 30%, over 30% to 40%, over 40% to 50%, over 50% to 60%, over 60% to 70%, over 70% to 80%, over 80% to 90%, or over 90% to 100% of the circumference of the liner of said injector wellbore at the longitudinal position of the hole in the liner of said injector wellbore.

18. The method according to claim 1, whereby the perforation pattern of the liner of said injector wellbore is adapted only in a first section of the liner of said injector wellbore including the heel section, said first section of the liner having a length corresponding to between ½and ⅓of the total length of the liner of said injector wellbore, from ⅓to ¼of the total length of the liner of said injector wellbore, or less than ¼of the total length of the liner of said injector wellbore, and that at least every other hole is plugged in said first section of the liner of said injector wellbore.

19. The method according to claim 18, whereby at least some holes of the liner of said injector wellbore are plugged with a sealant forming a plug that does not close the continuous annular space between the liner of said injector wellbore and the formation, whereby the plug is flush with an outer surface of the liner of said injector wellbore and an inner surface of the liner of said injector wellbore.

20. The method according to claim 18, whereby at least some holes of the liner of said injector wellbore are plugged with a sealant forming a plug that closes the continuous at least substantially annular space between the liner of said injector wellbore and the formation over less than 90% to 80%, over less than 80% to 70%, over less than 70% to 60%, over less than 60% to 50%, over less than 50% to 40%, over less than 40% to 30%, over less than 30% to 20%, over less than 20% to 10%, or over less than 10% of the circumference of the liner of said injector wellbore at the longitudinal position of the hole in the liner of said injector wellbore.

21. The method according to claim 18, whereby at least some holes of the liner of said injector wellbore are plugged with a sealant forming a plug that closes the continuous at least substantially annular space between the injector liner and the formation over 10% to 20%, over 20 % to 30%, over 30% to 40%, over 40% to 50%, over 50% to 60%, over 60% to 70%, over 70% to 80%, over 80% to 90%, or over 90% to 100%, of the circumference of the liner of said injector wellbore at the longitudinal position of the hole in the liner of said injector wellbore.

22. The method according to claim 1, whereby, before or after modifying the perforation pattern of the liner in one of the wellbores, a fracture, thief zone or high permeability zone in the formation surrounding the wellbore is sealed by injection of a sealant into the formation.

23. A method according to claim 1, whereby the perforation pattern of the injector liner is adapted only in a first section of the liner of said injector wellbore including the heel section, said first section of the liner of said injector wellbore having a length corresponding to less than ⅓of the total length of the liner of said injector wellbore.

24. A method according to claim 1, whereby the perforation pattern of the liner of said injector wellbore is adapted only in a first section of the liner of said injector wellbore including the heel section, said first section of the liner of said injector wellbore having a length corresponding to less than ¼of the total length of the liner of said injector wellbore.

* * * * *